US005333628A

United States Patent [19]

Ogata et al.

[11] Patent Number: 5,333,628

[45] Date of Patent: Aug. 2, 1994

[54] CONTINUOUS ULTRASONIC CLEANING APPARATUS

[75] Inventors: Akihiro Ogata, Ushizu; Yoshihiro Hirakawa; Masakatsu Soichi, both of Saga; Fumiyasu Kitano, Hyogo, all of Japan

[73] Assignee: Kyushu Sumitoku Electronics Co., Ltd., Japan

[21] Appl. No.: 849,391

[22] Filed: Apr. 28, 1992

[51] Int. Cl.[5] ..... B08B 3/10

[52] U.S. Cl. ..... 134/64 R; 134/122 R; 134/184; 134/102.1; 134/902

[58] Field of Search ..... 134/902, 73, 122 R, 134/64 R, 184, 98.1, 102.1, 1

[56] References Cited

U.S. PATENT DOCUMENTS

| | | | |
|---|---|---|---|
| 3,292,397 | 12/1966 | Wooliever | 68/3 SS |
| 3,688,527 | 9/1972 | Blustain | 68/3 SS |
| 3,929,409 | 12/1975 | Buchner et al. | 134/64 R |
| 4,100,926 | 7/1978 | Heim . | |
| 4,138,757 | 2/1979 | Henderson et al. . | |
| 4,176,531 | 12/1979 | Fleissner | 68/3 SS |
| 4,391,672 | 7/1983 | Lehtinen | 68/3 SS |
| 4,788,992 | 12/1988 | Swainbank et al. | 134/184 |
| 5,113,882 | 5/1992 | Gileta | 134/73 |
| 5,143,103 | 9/1992 | Basso et al. | 134/902 |
| 5,193,362 | 3/1993 | Otto | 68/3 SS |
| 5,203,798 | 4/1993 | Watanabe | 134/184 |

FOREIGN PATENT DOCUMENTS

| | | | |
|---|---|---|---|
| 1131592 | 2/1959 | Fed. Rep. of Germany . | |
| 2845586 | 5/1979 | Fed. Rep. of Germany | 68/3 SS |
| 4009721 | 10/1991 | Fed. Rep. of Germany . | |
| 3-77319 | 4/1991 | Japan | 134/184 |
| 687970 | 2/1953 | United Kingdom | 68/3 SS |
| 1385750 | 2/1975 | United Kingdom | 134/184 |

OTHER PUBLICATIONS

English Language Abstract of German Patent Document DE 4,009,721 A1.

*Primary Examiner*—Frankie L. Stinson

*Attorney, Agent, or Firm*—Harris Beach & Wilcox

[57] ABSTRACT

A continuous ultrasonic cleaning apparatus having excellent cleaning efficiency and holding/carrying capability of the product-to-be-cleaned is disclosed. The apparatus enables the speed of the conveyors to be increased, forced drying to be achieved and no stain nor water marks are formed even if water is used as a cleaning agent. The continuous ultrasonic cleaning apparatus utilizes a cleaning agent receiving/storage bath having a cleaning agent supplying/adding function for the cleaning bath positioned therebelow and an ultrasonic oscillator. Net conveyors for holding the product-to-be-cleaned are used and synchronized for carrying the product-to-be-cleaned. A high-speed air blower is mounted at a down-stream side of the cleaning bath. Even if water or pure water is used as a cleaning agent, the ultrasonic efficiency is high. When using the high-speed blower to dry the cleaning agent, the product is securely retained at its original position. No stain nor water marks are formed and an equivalent cleaning quality can be achieved as that when using fulone. Furthermore, by using an oxygen-free water and purging inert gas for the entire receiving/storage bath, any product having a propensity to be easily corroded can be effectively cleaned.

16 Claims, 3 Drawing Sheets

CONTINUOUS ULTRASONIC CLEANING APPARATUS

TECHNICAL FIELD

This invention is related to an ultrasonic cleaning apparatus for performing a continuous cleaning of various types of products including magnets after being ground, various metallic worked products susceptible to severe corrosion/rusting, products such as tubes with one end closed, or small size pieces which are normally hard to be cleaned. The ultrasonic cleaning apparatus includes a cleaning agent receiving-storage bath located underneath a cleaning bath in which an ultrasonic oscillator is installed, a net conveyor or a net convey or utilizing a holding net for holding products-to-be-cleaned or a pair of upper and lower net conveyors electrically driven in a synchronous manner for linear movement, provide a miniaturization of the cleaning bath and shortening of the cleaning operation line. Moreover, the apparatus will be simple and provides versatile industrial applications. By this cleaning apparatus, undesired movement or jumping around of products-to-be-cleaned can be avoided, and water drop marks can be eliminated by a forced drying operation using a high speed blower.

BACKGROUND ART

For normal operation on an industrial scale, an ultrasonic cleaning apparatus as seen in FIG. 3 has been employed for continuously cleaning ferrite magnets after they have been ground.

By passing the products to be cleaned 2, mounted on an endless net conveyor 1, between a pair of ultrasonic oscillators 4,4 which are placed inside a cleaning bath 3 filled with a cleaning agent 5, dirt on the products to be cleaned is washed off by the ultrasonic action.

However, according to the conventional type of cleaning apparatus, again referring to FIG. 3, both feeding-in angle to the cleaning bath 3 and feeding-out angle after cleaning are necessarily low in order to avoid any damages to the products-to-be-cleaned 2 carried by the endless conveyor 1 due to rotating action inside the cleaning bath, so that both slope portions 1*c*,1*d* of the net conveyor 1 need to be relatively long.

Hence, the length of the cleaning bath 3 itself will become longer, making miniaturization of the apparatus impossible. Moreover, because of the slope portions 1*c*, 1*d* on the conveyor 1, undesired rotating of the products-to-be-cleaned 2 can not be avoided completely, depending upon the shape of the products. Furthermore, product-to-be-cleaned 2 are occasionally caught causing breakages and/or cracks in products as they have the tendency to cut into the net portion.

Although the ultrasonic cleaners in an industrial scale must perform rapid and effective cleaning operation without reducing the cleaning efficiency, increasing the speed of the conveyor's movement or forced drying—which have heretofore been employed for increasing the cleaning efficiency—cause undesired movement of product-to-be-cleaned, resulting in scratches or cracks in products.

When the product-to-be-cleaned are small pieces or light weight pieces such as electronic components, their component may be replaced due to the vibration occurring during the ultrasonic cleaning operation.

As a cleaning agent, water, pure water, fulone, or methanol has been selectively chosen for the conventional method, For cleaning precise electronics components such as ceramics, methanol or fulone is preferably used as a cleaning agent based on considerations of the quality control and operation reliability. These types of cleaning agents are believed to avoid any occurrence of.

However, since use of the fulone has become strictly limited due to environmental pollution, alternative agents are under development, However, materials which possess equivalently high vaporizing rate and small surface tension as fulone, are expensive and not available in large mass production scale. Therefore, if water or pure water can be applied for cleaning the electronics components, it would be extremely beneficial to industrial usage.

OBJECTS AND SUMMARY OF THE INVENTION

It is, therefore, an object of this invention to provide a miniaturized ultrasonic cleaning apparatus with a shortened cleaning bath, without slope portions of the net conveyor which carries the products to minimize any damage to the products.

It is another object of this invention to provide a continuous ultrasonic cleaning apparatus with excellent cleaning performance and product holding capability, having an increased speed of the conveyor and improved forced drying, which eliminates water marks even if water or pure water is utilized as a cleaning agent.

DISCLOSURE OF INVENTION

After we have examined various possible structures of the cleaning bath in order to overcome the aforementioned technical drawbacks, we have found that they are overcome by using a cleaning bath having an ultrasonic cleaning function with a cleaning agent receiving-storage bath for supplying cleaning agent to the cleaning bath in order to maintain the appropriate level of the water as a cleaning agent.

After considerations of various structures in order to enhance the cleaning performance of the products and the holding capability of the products in the continuous ultrasonic cleaning apparatus, we have found that they are overcome by either mounting a holding net separately onto the net conveyor to transfer the products-to-be-cleaned or by using a holding net conveyor being synchronized to the net conveyor. In this manner, even small size products-to-be-cleaned can be safely transferred through a pre-cleaning shower prior to the ultrasonic cleaning or during the ultrasonic cleaning. Forced drying under a high-speed blower can then be applied, so that the water marks can be eliminated.

Furthermore, after investigating various design structures to water-clean products susceptible to corrosion, it was found that the atmosphere inside the cleaning bath or the blow gas can be altered to an inert gas by either aerating the closed cleaning bath with an inert gas, by supplying an oxygen-free water, or by enclosing the cleaning agent receiving-storage bath in which the cleaning bath, the blow equipment or drying apparatus is installed. Then, by down-streaming the inert gas and by using an oxygen-free water or pure water as a cleaning agent, the products can be cleaned without corrosion or rusting.

This invention provides, therefore, a two-bath type continuous ultrasonic cleaning apparatus consisting of (1) an inlet/outlet hole placed on the side portion of the cleaning bath through which a net conveyor can pass to carry the products-to-be-cleaned, (2) a cleaning bath being provided with at least a pair of ultrasonic oscillators positioned at upper and lower sides of the net conveyor in the cleaning bath, (3) a cleaning agent receiving/storage bath being placed underneath the cleaning bath to receive or store the outlet cleaning agent from the hole for the net conveyor of the cleaning bath, and (4) a cleaning agent circulation means to supply the cleaning agent from inside the cleaning agent receiving/storage bath to the cleaning bath.

This invention provides a continuous ultrasonic cleaning apparatus comprising (1) an inlet/outlet hole through which passes a net conveyor to move the products-to-be-cleaned, along with a holding net which holds the products-to-be-cleaned, a lower net conveyor to carry the products-to-be-cleaned, or an upper net conveyor synchronizingly driven with the lower net conveyor (2) a cleaning bath having at least a pair of ultrasonic oscillators placed at lower and upper sides of the net conveyor, (3) a cleaning agent receiving/storage bath placed underneath the cleaning bath in order to receive and store the cleaning agent flowing from the upper and lower inlet/outlet holes of the net conveyor, and (4) a cleaning agent circulating means to supply the cleaning agent in the cleaning agent receiving/storage bath to the cleaning bath.

The products-to-be-cleaned with which this invention may be used include a ferrite magnet as described later in one of embodiment of this invention, as well as various types of magnets, various types of ceramics, stones, glasses, precise electronics components, metallic worked pieces, and plastics.

Although water or solvents as a cleaning agent can be properly selected depending upon the type of products-to-be-cleaned, a solvent, unlike the organic solvent fulone, can be preferably chosen from water, oxygen-free water, pure water or fulone-alternatives. Even if the water is used as a cleaning agent, the continuous ultrasonic cleaning apparatus according to this invention eliminates water marks.

If necessary, a process can be added to degrease the products by use of solvents or the like in a pro-shower, being positioned outside the cleaning agent receiving/storage bath.

In this invention it is most desirable to dispose the cleaning agent receiving/storage bath beneath the cleaning bath so as to receive the cleaning agent flowing from the inlet and outlet holes of the cleaning bath.

The structure of the holding net can be any type which fuctions to hold the products-to-be-cleaned onto the lower net conveyor which its self-weight, or the holding net can be hooked to the net conveyor, or can be mounted in an open/close manner.

Although there is no limitation for the material of the holding net, as well as the conveyor, it is necessary to determine the structure of the holding net and size and shape of the hole, depending upon the type of products-to-be-cleaned, shape/size, weight, ultrasonic cleaning conditions, or operation conditions of the blower equipment. Particularly, it would be preferable to design the net in such a way that the water can be easily drained off.

In this invention both upper and lower net conveyors are to move continuosly at the same speed. Hence, synchronizing is achieved by an electric control of both motors or a mechanical synchronizing means to maintain the same speed of both conveyors in the approaching zone of the lower and upper net conveyors.

The clearance between these net conveyors may be a distance which is wide enough for the products just to be sandwiched, and the distance can be changed due to the size of the products-to-be-cleaned. For example, the aproaching distance between the lower and upper net conveyors can be set in order to hold the products-to-be-cleaned by the self-weight of the upper net conveyor.

The material for the net can be properly selected in the same way as for the holding net.

According to this invention the paired ultrasonic oscillators can be disposed in the face-to-face relation vertically or laterally through the net conveyors in the cleaning bath. In consideration of the cleaning efficiency it is preferable to dispose the ultrasonic oscillators in the face-to-face relation vertically through the net conveyors. Further, although the number of the paired ultrasonic oscillators can be selectively determined depending on the dimension of the apparatus, the material or size of the product-to-be-cleaned, it is preferable to dispose at least a pair of ultrasonic oscillators in the advancing direction of the net conveyors.

In order to eliminate the stain or water mark during a short drying period, it is preferable to provide a blower device using air or inert gas, at the lower side of the cleaning bath with respect to the moving direction of the net conveyors, Moreover, compressed air supplied by an air compressor can be applied instead of the blower.

The flowing rate of the blower device is desired to be high enough to avoid the formation of stain or water marks; therefore, it is preferable to about 100–200 m/sec. If the flowing rate is too slow, it shows a tendency to exhibit stain or water marks when, particularly, water is used as a cleaning agent. On the other hand, if the flowing rate is too high, the products might be moved.

Although the size, shape, location or number of exhaust nozzles of the blower device can be properly selected depending upon the flowing rate and/or the shape and size of the products. The following structures will be preferably employed in order to dry the solvents on the products and to avoid the stain or water marks on the products; namely they are (1) blowing the air from both lower and upper sides of the net conveyors after positioning the exhaust nozzles to direct air linearly across the conveyors, (2) blowing the air by changing the blowing angle, or (3) blowing the air from a plurality of blower devices on both lower and upper sides in opposite sides at equal distances along the advancing direction of the net conveyor.

Furthermore, another structure can be applied in such a way that a distance between the nozzle and the net conveyor can be varied.

Of the most importance with the blower device is the cleanness of the gas, as the cleanness will significantly affect the formation of water marks. Hence, various filters or air cleaners can be employed to achieve the desired cleanness of the gas.

Although the blower device uses a chamber which is totally closed, or partially opened, to the cleaning agent receiving/storage bath, it is recommended to exhaust the air in order to minimize splashing of the cleaning agent inside the chamber.

Moreover, as structure for venting the inert gas out of the inlet/outlet hole of the conveyor can be applied to control the inert atmosphere inside the cleaning agent receiving/storage bath in order to avoid entering particles.

In this apparatus, in addition to the two-bath type of cleaning bath, consisting of a cleaning bath and cleaning agent receiving/storage bath, it is also possible to enhance the cleaning efficiency and perform rapid drying by having a pre-cleaning apparatus, such pre-cleaning apparatus can be a shower of water or solvents prior to the cleaning bath, or using a rotating brush and flaps to prevent leakage of the cleaning agent flowing from the cleaning bath to the outside of the cleaning apparatus. Other cleaning approaches can be used such as a shower after the cleaning bath, a drying device such as a heater, or a heating temperature controlling device, as described hereinafter with reference to the first embodiment.

For economical purpose this invention employs a cleaning agent circulating means to supply the cleaning agent received in the cleaning agent receiving/storage bath to the cleaning bath.

The cleaning agent circulating means, using the cleaning agent receiving/storage bath according to this invention as described later, supplies and circulates the cleaning agent of the receiving/storage bath by means of a circulating pump. The cleaning agent circulating means also reduces the flow of the cleaning agent and maintains the level of the cleaning liquid by providing a cleaning agent venting portion inside and outside of the inlet/outlet holes of the cleaning bath to reduce the presure inside the cleaning bath by using a lid as an opening portion, which has inlet/outlet holes as does the net conveyor. Furthermore, another cleaning agent circulating means can be used so that the circulating amount and flowing amount are increased by providing a hope at the bottom portion of the cleaning bath to enhance cleaning of the cleaning agent inside the cleaning bath.

Proper selection of the type of circulating pump and location as well as the position of the cleaning agent supply hole in the cleaning bath is determined by the purpose of usage and the position of the apparatus.

Moreover, means can also be providd to vent or supply inert gas and supply oxygen-free water into the cleaning bath, which as inlet/outlet holes for only an opening portion of the net conveyor, by using a lid, by reducing the dissolved oxygen content inside the cleaning bath down to less than 1% in order to prevent the rust occurrence on the products.

DETAILED DESCRIPTION OF A PREFERRED EMBODIMENT

Embodiment 1

Figure 1:
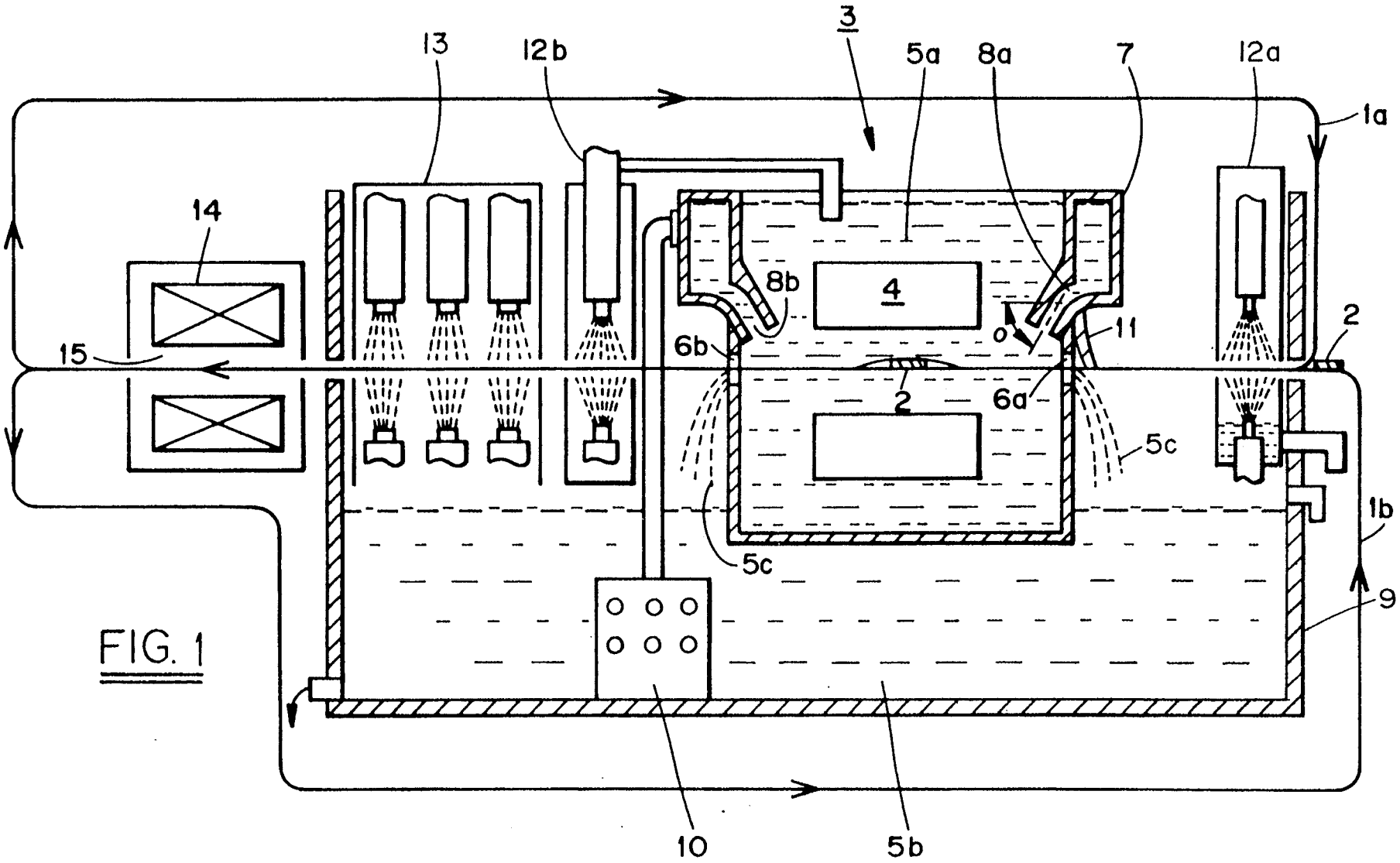
FIG. 1 is a figure showing a structure of the first embodiment of the cleaning apparatus according to this invention.

The cleaning bath 3 is structured in such a way that lower and upper superimposed net conveyors 1*a*,1*b* are movable in a horizontal direction, a left-right direction as seen in the drawing, relative to the side portion of the bath. In order to mount the product-to-be-cleaned 2 on the lower net conveyor 1*b*, and to hold it down by the upper net conveyor 1*a* to carry it, an inlet hole 6*a* and an outlet hole 6*b* are provided at a center portion of the side of the bath. The upper net conveyor 1*a* enters from the inlet hole 6*a* into the cleaning bath 3 along with the product-to-be-cleaned 2 held therebetween by the lower net conveyor 1*b*. They then are passed between a pair of ultrasonic oscillators 4,4 mounted at lower and upper sides of the net conveyors 1*a*,1*b* on opposite sides, with the product-to-be-cleaned carried out through the outlet hole 6*b*.

The upper net conveyor la forms a loop around the upper portion of the cleaning bath 3, and the lower net conveyor 1*b* forms another loop around the cleaning bath 3. Both upper net conveyor 1*a* and the lower net conveyor 1*b* are driven by separate motors (not shown in the figure), with each motor being controlled electrically to synchronize movement with the other.

In this embodiment, stainless steel net is utilized for both lower and upper net conveyors.

Although the cleaning bath 3 is filled with the cleaning agent 5*a*, since some portion of the cleaning agent will flow from the inlet/outlet holes 6*a*,6*b* in the cleaning bath 3, the level and amount of the cleaning agent 5*a* can not be maintained at this condition, Hence, in order to maintain the cleaning agent at proper level and amount, a cleaning agent receiving/storage bath (hereafter, receiving/storage bath) 9 is provided underneath said cleaning bath 3, and a cleaning agent circulating pump (hereafter, circulating pump) 10 for the cleaning agent 5*b* is provided to circulate or supply the cleaning agent into the cleaning bath 3.

The cleaning agent 5*b* inside the receving/storage bath 9 is carried to a cleaning agent supplying/adding bath (hereafter, supplying/adding bath) 7 located at an upper portion of the cleaning bath 3 by means of the circulating pump 10, and sprayed from spraying holes 8*a*,8*b* near by the inlet/outlet holes 6*a*,6*b* of the lower/-upper net conveyors 1*a*,1*b* into the cleaning bath 3 directed at the lower/upper net conveyors 1*a*,1*b*.

The spraying hole 8*a*, 8*b* can be located at any place unless they are inside the cleaning bath 3. However, it is preferable to have downwardly oriented spraying holes adjacent to the inlet/outlet holes 6*a*,6*b*, as this embodiment indicates.

Since the cleaning agent 5*b* is sprayed from the spraying holes 8*a*,8*b* in the shape of a curtain, the required amount of the cleaning agent 5*c* flowing from the inlet/-outlet holes 6*a*,6*b* can be minimized, and a proper amount of cleaning agent 5*a* inside the cleaning bath 3 can be maintained.

It is, particularly, desired to supply the proper supplying amount and pressure of the cleaning agent 5*b* supplied by the circulating pump which depends upon the sizes of the inlet/outlet holes 6*a*,6*b* of the lower/upper net conveyors 1*a*,1*b*, for determining the flow and amount of the cleaning agent 5*a*.

Although an embodiment using an in-water type pump—namely, the main body of the circulating pump 10 is placed in the receiving/storage bath 9 (in other word, cleaning agent 5*b*)—is shown in the figure, it is not necessary that the circulating pump 10 be mounted inside the receiving/storage bath 9, but can be constructed outside of the receiving/storage bath 9, depending upon available surrounding space, shape and size of the receiving/storage bath 9, and shape and size of the circulating pump 10.

Although the cleaning agent in the cleaning bath 3 and the receiving/storage bath 9 is filtered through a filtering device or filter in the pump itself (not shown in the figure) during the circulation, fresh cleaning agent might be added by, for example, discharging a portion from the drain located on the bottom portion of the receiving/storage bath 9 and supplying a make-up portion by-pass from the fresh cleaning agent shower 12*b*, as shown in the figure.

Besides a double-structured cleaning agent bath 3 and the receiving/storage bath 9 of this invention, cleaning efficiency, as well as effective drying, can be attained by mounting a flap 11 to prevent the splash of the cleaning agent into the inlet side of the cleaning bath 3 (right side of the figure) and a pre-shower 12*a*, or by providing a cleaning shower 12*b* at the left side of the outlet side of the cleaning bath to rinse and to add to the cleaning agent, an air blower 13 to dry, or heater 14 with a blower (not shown in the figure).

The illustrated air blower 13 is of a type having three nozzles in series placed at equal distances apart. The nozzles discharge a linear-shape of air across the width direction of the net conveyor and can achieve a large amount of discharge with high-speed.

The cleaning agent can discharge to the receiving/storage bath 9 when the bottom portion of the chamber is opened.

In order to control the speed of the net conveyors 1*a*,1*b*—depending upon the size, shape, and amount of the product to be cleaned—controlling means, for example, for sensing through a thermometer mounted in the ray heater, can be utilized along with said synchronizingly-driven control.

In order to mount the net conveyors 1*a*,1*b* straight inside the cleaning bath 3, without any unnecessary slack, it is desirable to provide a torque-limiter or the like in the rotating driving system of the net conveyors 1*a*,1*b*.

In the cleaning system as being described, the product-to-be-cleaned 2 previously cleaned—mounted on the lower net conveyor 1*b*, and carried on the upper net conveyor 1*a* while being pressed by its inherent or self-weight,—is transferred to the cleaning bath through the inlet hole 6*a* of the cleaning bath 3, and cleaned by an ultrasonic reaction while passing through a pair of ultrasonic oscillators 4,4, and synergistic effect of the stirring of the cleaning agent 5*b* being sprayed from the downward spraying holes 8*a*,8*b*. Then it is carried out from the outlet hole 6*b*, followed by an additional cleaning or rising, and drying process, to complete the required cleaning operation.

Particularly, since the product-to-be-cleaned 2 is held by the lower and upper net conveyors 1*a*,1*b*, it does not move by the ultrasonic vibration while being carried into the cleaning bath 3. It does not move during the post-process drying proces or by the spraying of the cleaning agent and during drying by a high-speed blower either.

Therefore, even when water or pure water is used as a cleaning agent 5*b*, the ultrasonic cleaning efficiency is high, and any undesired stain or water marks can be avoided by using an air blower 13 to discharge a high-speed clean air to instantaneously remove the cleaning agent.

Moreover, although the cleaning agent 5*a* in the cleaning bath 3 is flowed from the inlet/outlet holes 6*a*,6*b* of the net conveyor, a proper level of the cleaning agent can always be maintained because the cleaning agent 5*b* is circulated and supplied from the receiving/storage bath 9 according to an amount of flowed cleaning agent 5*c*.

By applying the aforementioned ultrasonic cleaning system as seen in FIG. 1 to clean the ferrite magnets after they are ground, it was found that the necessary length of the cleaning bath was only 0.7 m, and the receiving/storage bath need only be 1.5 m in length to exhibit equivalent cleaning performance as the conventional type which needs more than 3 m for the cleaning bath. Therefore, the length required can be shortened to less than half of the conventional type.

All additional equipment, including, a pre-cleaning apparatus such as a shower prior to the cleaning bath, a cleaning device such as a shower after the cleaning bath, an air blower device, and drying equipment such as a heater, can be constructed in a three-dimension manner within the total length of the cleaning bath itself. Therefore, the whole system can be miniaturized to less than ¼ of the conventional type.

For application to ferrite magnets, water was utilized as a cleaning agent for this invention as well as the conventional type, The carrying speed of the net conveyors speed was 2.0 m/min. The size of the ultrasonic oscillator was W160 mm×L460 mm×H95 mm. In this invented apparatus, the circulation pump has a circulating capacity of 400 liter/min.

In this cleaning apparatus, as seen in FIG. 1, electronic components as products-to-be-cleaned were cleaned by using water as a cleaning agent, and dried by an air blower device under air flowing rate of 200 m/sec. It was found, under these cleaning conditions, that (1) these components being held between the lower and upper net conveyors did not move from their original mounted positions after the cleaning, and (2) the cleaned components had no stain nor water marks either.

It was also found that tubes with one end closed, which are usually hard to be cleaned, were cleaned with excellent results.

Embodiment 2

Figure 2:
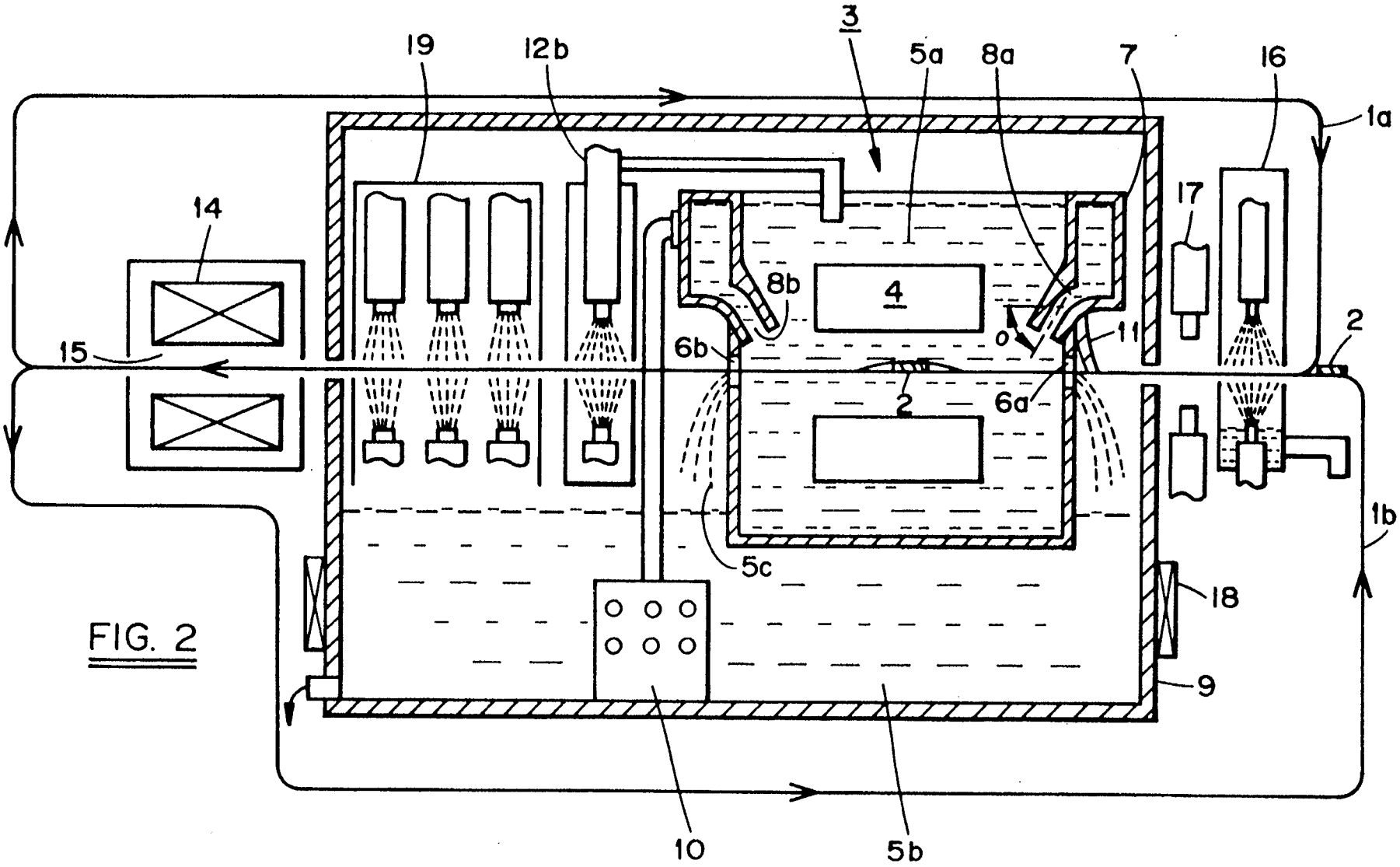
FIG. 2 shows a structure of cleaning apparatus of the second embodiment according to this invention.
Figure 3:
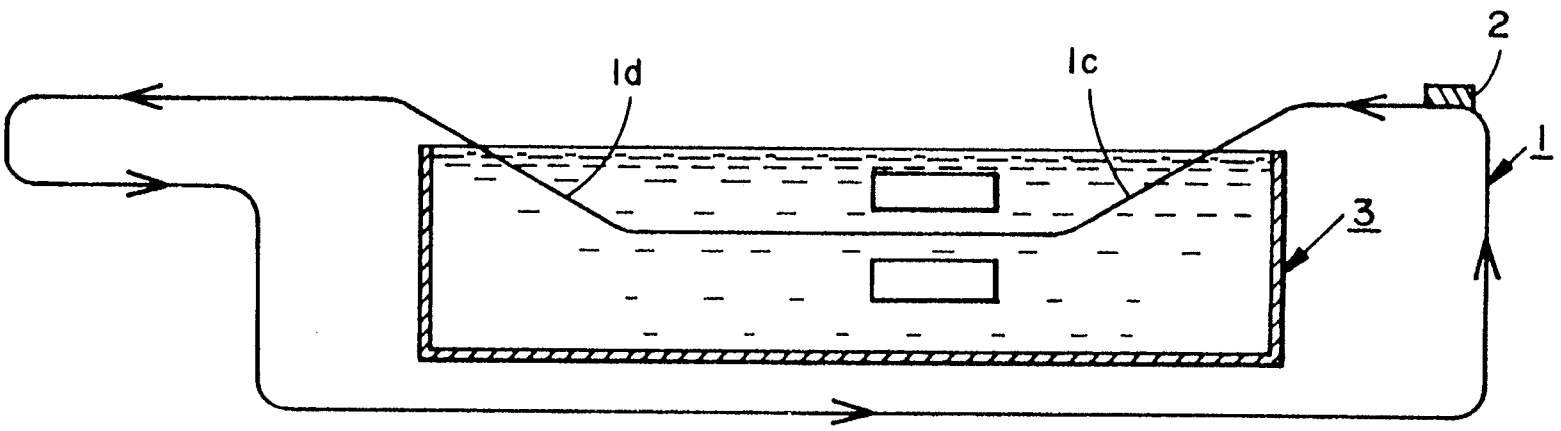
FIG. 3 is a structure of the conventional type of cleaning apparatus.

Although the continuous ultrasonic cleaning apparatus illustrated in FIG. 2 has basically similar structure as that seen in FIG. 1, a pre-cleaning agent shower 16 is provided outside of the receiving/storage bath 9, a lid is provided for the receiving/storage bath 9 to open only the inlet/outlet holes of the net conveyors 1*a*,1*b*, and an apparatus for supplying/exhausting $N_2$ gas (not shown in figure) is provided. A high-speed $N_2$ gas was discharged from the blower device 19. $N_2$ gas is also discharged from the inlet/outlet holes of the net conveyors 1*a*,1*b* to avoid entry of any outside air and to make a $N_2$ gas atmosphere inside the receiving/storage bath 9.

Although the $N_2$ gas of the blower device is the $N_2$ gas circulating inside the receiving/storage bath 9, and added as necessary, the circulated gas in this invention is cleaned by a cooler to separate it from the cleaning agent vapor.

The cleaning agent 5*a*,5*b* was an oxygen-free water, and supplied sufficiently from the oxygen-free water generator (not shown in the figure). A heater 18 is placed around the receiving/storage bath 9, to heat the cleaning agent 5*b*, for example at 50° C., if necessary. Although in this embodiment a pre-cleaning agent shower 16 is provided outside of the receiving/storage bath 9, if it is placed adjacent to the cleaning bath 3, as the first embodiment, the cleaning agent for the pre-cleaning agent shower is also heated by said heater 18 to improve the cleaning efficiency.

The product-to-be-cleaned 2 is firstly pre-cleaned or degreased with the oxygen-free water or solvent cleaning agent, if necessary, in the pre-cleaning agent shower 12*a*. The cleaning agent is next blown away by the high-speed blower 19. the product-to-be-cleaned is then carried into the receiving/storage bath 9, and ultrasonically cleaned with the oxygen-free water inside the cleaning bath 3.

When using the solvent cleaning agent at the pre-cleaning agent shower 16, it would be better to clean under the oxygen-free water by an another pre-cleaning agent shower 12*a* adjacent to the cleaning bath 3 inside of the receiving/storage bath 9, similarly for the first embodiment.

After being ultrasonically cleaned in the cleaning bath 3, the product is rinsed under the cleaning shower 12*b*, dried under a high-speed $N_2$ gas at the blower device, and further dried by the far infrared rays heater. This process is similar to the first embodiment except that a high-speed $N_2$ gas was utilized. In either case, the resulting cleaning efficiency was found equivalent.

Since the continuous ultrasonic cleaning apparatus as seen in FIG. 2 uses the oxygen-free water as a cleaning agent, and $N_2$ gas as an atmospheric gas, products susceptible to corrosion such as Fe-B-R system magnets or other metal worked products can be cleaned without any stain or water marks.

Industrial Applicability

The continuous ultrasonic apparatus according to this invention increases the amount of cleaning agent supplied because of a cleaning agent circulating means, and has a high cleaning efficiency due to a stirring effect of the cleaning agent, so that cleaning operation can be shortened. The product to be cleaned is steadily held, since they are held and carried between lower and upper net conveyors, so that they do not move during the cleaning and drying processes. Moreover, the products do not move under the forced drying by the blower. Particularly, no stain nor water marks are noticed due to a high-speed blower.

The continuous ultrasonic cleaning apparatus according to this invention can be structured with less than a half length of the cleaning bath of the conventional type, so that a remarkable miniaturization can be realized. Moreover, the net conveyors carrying the products can be arranged in a straight line, hence the products are more free from damages. In general this continuous ultrasonic cleaning system can, therefore, be structured with a small scale, and offer an excellent efficiency in versatile applications in various industrial sectors.

Furthermore, by having the entire system in an inert gas atmosphere, using an oxygen-free water as a cleaning agent, and blow-drying under the inert gas, products which are easily corroded can be effectively cleaned. Hence, various industrial products can be cleaned, by using water, with equivalent cleaning quality as when using fulone.

What is claimed is:

1. A continuous ultrasonic cleaning apparatus comprising:

a cleaning bath provided on its each side with an inlet hole and an outlet hole to enable net conveyors for carrying a product-to-be-cleaned to be moved passing through said inlet hole and said outlet hole and at least a pair of ultrasonic oscillators disposed in a face-to-face relation in said cleaning bath through said net conveyors;

a cleaning agent receiving/storage bath disposed below said cleaning bath for receiving a cleaning agent flowing from said inlet and outlet holes of said cleaning bath;

a recirculating means for supplying a cleaning agent from said cleaning agent storage bath to said cleaning bath; and means for spraying the cleaning agent downwardly into said cleaning bath, said means for spraying being provided in a vicinity of said inlet and outlet holes.

2. The apparatus in accordance with claim 1, wherein a path of movement of said product-to-be-cleaned and said net conveyor means comprises a direct line between said inlet hole and said outlet hole, and said inlet hole and said outlet hole regulate a level of cleaning fluid within said cleaning bath.

3. A continuous ultrasonic cleaning apparatus comprising:

a cleaning bath for containing a cleaning agent to clean a product-to-be-cleaned passed in contact therewith, said cleaning bath having an inlet hole and an outlet hole formed therein;

net conveyor means passing in a path of movement into and out from said cleaning bath through said inlet hole and said outlet hole respectively, for carrying a product-to-be-cleaned;

at least a pair of ultrasonic oscillators, with a member of said pair being positioned adjacent the path of said net conveyor means on each side thereof inside said cleaning bath;

a cleaning agent receiving/storage bath positioned below said cleaning bath to receive and store a cleaning agent flowing from said net conveyor means;

recirculating means for supplying a cleaning agent from said cleaning agent receiving/storage bath to said cleaning bath; and means for spraying the cleaning agent downwardly into said cleaning bath, said means for spraying being provided in a vicinity of said inlet and outlet holes.

4. The apparatus of claim 3 further including a holding net means movable with said net conveyor means for holding a product-to-be-cleaned.

5. The apparatus of claim 3 wherein said net conveyor means includes a lower net conveyor and an upper net conveyor moving synchronously with said lower net conveyor.

6. The apparatus of claim 3 further including heating means for heating the cleaning agent.

7. The apparatus of claim 3 further including a distance controlling means for controlling the distance between the product-to-be-cleaned and said ultrasonic oscillator when carried through said cleaning bath.

8. The apparatus of claim 3 further including pre-cleaning means positioned in said path of movement before said inlet hole to said cleaning bath and post-cleaning means positioned after said outlet hole from said cleaning bath for pro-cleaning and post-cleaning of the product-to-be-cleaned, respectively.

9. The apparatus of claim 8 further including blower means for applying air pressure to the product-to-be-cleaned, drying means for applying heat to the product-to-be-cleaned, and said blower means and said drying means both being positioned in said path of movement after said outlet hole.

10. The apparatus of claim 9 further including a distance controlling means for controlling the spacing between the product-to-be-cleaned and said blower means.

11. The apparatus for claim 8 further including a blower means positioned between said pre-cleaning means and said inlet hole for applying air pressure to pre-cleaned products prior to passing into said cleaning bath.

12. The apparatus of claim 8, wherein said cleaning agent receiving/storage bath comprises a substantially closed-structure, and means for supplying an inert gas from the blower means to said cleaning agent receiving/storage bath for purging air therefrom.

13. The apparatus of claim 12 wherein the cleaning agent is an oxygen-free water or pure water.

14. The apparatus of claim 8 wherein said pre-cleaning means is provided for degreasing the products-to-be-cleaned.

15. The apparatus in accordance with claim 3, wherein said path of movement of said net conveyor means comprises a direct line between said inlet hole and said outlet hole, and said inlet hole and said outlet hole regulate a level of cleaning fluid within said cleaning bath.

16. A continuous ultrasonic cleaning apparatus comprising:

a cleaning bath for containing a cleaning agent to clean a product-to-be-cleaned passed in contact therewith, said cleaning bath having an inlet hole and an outlet hole formed therein;

net conveyor means comprising a lower net conveyor and upper net conveyor moving synchronously with said lower net conveyor, said net conveyor means passing in a path of movement into and out from said cleaning bath, said path of movement comprising a single substantially straight line through said inlet hole and said outlet hole respectively, for carrying a product-to-be-cleaned;

heating means for heating cleaning agent;

pre-cleaning means positioned in said path of movement before said inlet hole to said cleaning bath for pre-cleaning of the product-to-be-cleaned;;

post-cleaning means positioned after said outlet hole from said cleaning bath for post-cleaning of the product-to-be-cleaned;

blower means for applying air pressure to the product-to-be-cleaned disposed in said path of movement after said outlet hole;

drying means for applying heat to the product-to-be-cleaned disposed in said path of movement after said outlet hole;

at least a pair of ultrasonic oscillators, with a member of said pair being positioned adjacent the path of said net conveyor means on each side thereof inside said cleaning bath;

distance controlling means for controlling the distance between the product-to-be-cleaned and said ultrasonic oscillator when said product-to-be-cleaned is carried through said cleaning bath;

a cleaning agent receiving/storage bath positioned below said cleaning bath to receive and store a cleaning agent flowing from said net conveyor means, said receiving/storage bath comprising a substantially closed structure;

means for supplying an inert gas to said receiving/storage bath for purging air therefrom;

recirculating means for supplying a cleaning agent from said cleaning agent receiving/storage bath to said cleaning bath; and means for spraying the cleaning agent downwardly into said cleaning bath, said means for spraying being provided in a vicinity of said inlet and outlet holes.

* * * * *

UNITED STATES PATENT AND TRADEMARK OFFICE

CERTIFICATE OF CORRECTION

PATENT NO. : 5,333,628

DATED : August 2, 1994

INVENTOR(S) : Ogata et al.

It is certified that error appears in the above—identified patent and that said Letters Patent is hereby corrected as shown below:

On the title page, item

--[30] Foreign Application Priority Data

February 12, 1992 [JP] Japan...059407/4--

Signed and Sealed this

Sixth Day of December, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,333,628

DATED : August 2, 1994

INVENTOR(S) : Akihiro Ogata, et. al.

It is certified that error appears in the above-indentified patent and that said Letters Patent is hereby corrected as shown below:

Title page, after "[73] Assignee: Kyushu Sumitoku Electronics Co., Ltd., Japan", insert-- Imaizumi Iron Works Co., Ltd. and Sumitomo Special Metals Co., Ltd., Japan--.

Signed and Sealed this

Eighth Day of April, 1997

*Attest:*

Bruce Lehman

BRUCE LEHMAN

*Attesting Officer*

*Commissioner of Patents and Trademarks*